United States Patent [19]

Wolman

[11] Patent Number: 5,000,338

[45] Date of Patent: Mar. 19, 1991

[54] DRINKING AID

[76] Inventor: Michael Wolman, 49 Sorotzkin Street, Jerusalem, Israel

[21] Appl. No.: 407,929

[22] Filed: Sep. 15, 1989

[30] Foreign Application Priority Data

| | | | |
|---|---|---|---|
| Sep. 19, 1988 | [IL] | Israel | 87804 |
| Feb. 27, 1989 | [IL] | Israel | 89435 |
| Apr. 17, 1989 | [IL] | Israel | 89995 |
| May 2, 1989 | [IL] | Israel | 90160 |

[51] Int. Cl.[5] ..... A47G 19/22

[52] U.S. Cl. ..... 220/90.6; 220/90.4

[58] Field of Search ..... 220/256, 257, 258, 90.2, 220/90.4, 90.6

[56] References Cited

U.S. PATENT DOCUMENTS

| | | | |
|---|---|---|---|
| 2,552,318 | 5/1951 | Hartmann | 220/90.6 |
| 2,613,846 | 10/1952 | Shulman | 220/90.2 X |
| 2,725,732 | 12/1955 | Somoza | 220/90.6 |
| 2,729,956 | 1/1956 | Gilbert | 220/90.2 X |
| 3,103,297 | 9/1963 | Taft | 220/90.2 |
| 3,185,341 | 5/1965 | Barbour | 220/90.6 |
| 3,341,062 | 9/1967 | Phillips | 220/90.4 |
| 4,693,410 | 9/1987 | Selz | 229/1.5 B |
| 4,715,510 | 12/1987 | van der Meulen et al. | 220/90.4 |
| 4,717,037 | 1/1988 | van der Meulen | 220/90.6 |

FOREIGN PATENT DOCUMENTS

| | | | |
|---|---|---|---|
| 0864155 | 3/1961 | United Kingdom | 220/90.2 |

*Primary Examiner*—Stephen Marcus
*Assistant Examiner*—Nova Stucker
*Attorney, Agent, or Firm*—Michael N. Meller

[57] ABSTRACT

A cup is described which can be mounted on a can, for directly drinking a liquid contained in the can. The cup is suitable for covering and protection of the can top during storage, and for containing illustrative material.

8 Claims, 4 Drawing Sheets

DRINKING AID

The present invention relates to mountable drinking means to be used together with a drink can. More particularly, the invention relates to a cup which can be mounted on a can, for directly drinking a liquid contained in the can.

Canned drinks, which are practically universally used, while representing a convenient way to store, cool and transport drinks, present severe drawbacks in drinking therefrom. The can is opened by pulling a tongue connected to a ring, thus providing a drop-shaped opening on the upper portion of the can. The upper portion of the can is depressed with respect to the upper portion of the can walls. Therefore, dirt is often entrained in the upper portion of the can, and it is difficult to avoid coming into contact with it. Furthermore, because of their shape, wiping out any such dirt is relatively difficult.

Additionally, drinking from the opening formed in the upper portion of the can may cause inconvenience. Liquid often overflows and wets the outer walls of the can. Furthermore, drinking gassed liquids from a relatively small opening is uncomfortable, because of bubble rise through the liquid. Drinks, furthermore, acquire an aftertaste when drunk from a metallic can. This is true of most drinks, but is specially felt when drinking beer. When the drink is poured into a cup, the aftertaste disappears or at least is greatly reduced.

It is therefore clear that it would be highly desirable to provide means for drinking from drink cans, which are both more hygienic and comfortable.

It is therefore an object of the present invention to provide an accessory which can be easily mounted on a drink can to provide hygienic and comfortable drinking means.

It is another object of the invention to provide a cup which is easily mountable on a drink can, and through which liquid stored in the can can be easily drunk.

Thus, in accordance with the present invention, there is provided a device adapted to directly drinking a liquid from a drink can, which comprises an open bottom portion fitted with connecting and sealing means, and a rim connected to its bottom portion, said rim being adapted to receive the liquid passing from the can, through the opening in the said bottom portion of the device, and said rim being suitable for directly drinking therefrom.

An example of suitable sealing means is a bayonet-like connection provided in the circumference of the bottom part of the device, which bayonet-like connection is capable of engaging the low rim provided in the upper part of every can.

While the most convenient shape of the rim is the circular one, it will be apparent to the skilled person that any other suitable shape, such as crescent-like, semi-circular, square, etc., is possible, as long as the rim can be exploited for drinking purposes. The device of the invention can be made of any suitable material. However, because of its nature, the device will in most cases be a disposable one. Therefore, disposable mountable cups made according to the invention can conveniently be made of plastic material, or of plasticized or impermeabilized paper, such as laminated paper. Biodegradable material can also be suitably used.

In accordance with a preferred embodiment of the invention, an additional major problem is solved. The said problem is that different cans have different diameters of the so-called drinking rim. In general, although this is not always so, the diameter of drinking rims of cans sold in America is smaller than the drinking rim of European cans. It is thus necessary to adapt the sealing and fastening means of the cup to the different diameters of the drinking rims of the different cans.

A number of drinking attachments are known in the art, which can be used for directly drinking from a can, and which before use are mounted on the can, either at its bottom or around it, or at its top. One problem with existing cups is that if they are bottomless, and mounted at the bottom of the can, they collect dirt and are not clean enough for use when the can is to be opened. If bottomless cups are mounted at the top, they do not provide any protection for the upper part of the can on which, and around the drinking rim of which, dirt collects. Other drinking attachments of the type hereinafter described comprise a bottom portion, which usually is provided with an opening through which liquid flows. These devices have the considerable drawback of, again, not providing a solution of the problem of dirt collecting on the can. When such a cup is mounted at the bottom of the can, then its bottom may become dirty, and the top of the can, of course, is not protected so that dirt may continue to collect on it and around the drinking rim thereof. If the drinking attachment is placed upside-down on the top portion of the can, here again its bottom part may become dirty so that when it is mounted for drinking purposes, dirt collected on its bottom portion gets mixed with the liquid.

It is therefore one of the objects of the present invention to provide a drinking attachment or cup which overcomes also the aforesaid problems.

It is another object of the invention to provide a drinking attachment which may house a bottom portion which is not an integral part of the cup, and which may be easily removed before drinking. This bottom may consist of a thin layer of material, or of multiple layers of material such as paper.

Another problem of existing drinking attachments is that, if connected before use to the upper portion of the can, and turned upside down, they do not firmly grip the can, and may become disconnected therefrom due to the weight of the liquid contained in the can if the assembly is lifted from the cup.

It is therefore a further object of this invention to provide a drinking attachment or cup which overcomes also this problem.

Thus, according to one embodiment of the invention, the drinking attachment comprises positioning means located near its inner bottom portion, which positioning means are adapted to maintain a removeable bottom portion in a predetermined position, and a bottom portion which is removably connected to the drinking attachment by the action of the positioning means. According to a still preferred embodiment of the invention, the said positioning means comprise two or more protrusions provided in the inner surface of the drinking rim. The positioning means may comprise protrusions of this type provided at different heights along the drinking rim, or may comprise protrusions and a bottom rim or ring which may be provided at the bottom of the cup, and which may house connecting means, either for connecting the inside of the cup or its outside to the can.

In a preferred embodiment of the invention, the drinking attachment comprises inner connecting means adapted to connect the drinking attachment, when turned upside down, to the upper rim of the can which is then housed within the cup. In a preferred embodiment of the invention, the said inner connecting means comprise two or more substantially U-shaped elements, which when a pressure is applied to the bottom of the cup engage the upper rim of the can in a bayonet-like engagement. These U-shaped elements may also be replaced by circular connecting means having a substantially U-shaped cross-section. In this case, however, it is desirable to make such circular connecting means discontinue, to prevent liquid from filling it the U-shaped void space.

If desired, the outer connecting and fastening means can be of the type comprising circular connecting means having a substantially U-shaped cross-section, which engage the upper rim of the can when a pressure is applied, and which are similar to the inner connecting means described above. Furthermore, two concentric outer connecting and fastening means can be provided, if desired.

The cup according to this embodiment of the invention is particularly suitable for advertising purposes. The removeable bottom portion, which is advantageous in itself, as it prevents dirt from collecting either on the top of the can or on the cup, may further contain a written or visual message. Thus, for instance, this removeable bottom portion may contain advertising material, may consist of a button, or may contain informative material. The bottom portion, if made of paper or paper-like material, may further comprise a number of layers, each layer being written on one or both sides, so that a relatively large amount of information can be contained in each of the said removeable bottom portions. The use of the cup of the invention for advertising purposes is, therefore, also part of the present invention.

According to another preferred embodiment of the invention, the bottom portion, which is removably connected to the drinking attachment, is independent of any positioning means. In practice, if the removable bottom closing portion of this invention is removably attached to the drinking attachment from the outer bottom portion thereof, still the inner bottom portion of the drinking attachment is free for containing an additional removable bottom portion, which may or may not be held in a predetermined position by the action of suitable positioning means.

The advantages of the device according to this embodiment of the invention are many-fold. First of all, if adhesive means are provided in the outer bottom portion, a better closure, similar to an actual sealing, may be obtained with a considerable improvement in the prevention of dirt infiltration. Furthermore, removing an outer removable bottom portion, e.g., by peeling it off, is easier and simpler than removing a removable bottom portion which is located in the inside of the drinking attachment. Additionally, if appropriate adhesion properties are provided, very thin material can be employed for the bottom sealing portion, in contrast to the rather rigid nature of an inner removable bottom portion.

As will be apparent to a skilled person, providing the outer bottom closure makes it possible still to add an inner bottom portion, which is removable, and which may contain informative material, while additional informative material can be printed on the outside of the bottom closing portion, which, when the drinking attachment is turned upside down, to house and firmly grip the drink can, is the uppermost and visible portion of the drink can/drinking attachment assembly. Furthermore, if additional adhesive material is provided on the inner part of the bottom closing portion, this adhesive material may be used to hold an inner removable bottom portion in place, without the need for positioning means provided in the drinking attachment itself.

In another preferred embodiment of the invention, the cup is further provided in the inner portion of its drinking rim with a plurality of protrusions, which may be in the shape of rings. These protrusions or rings have the purpose of providing some "pressure points". When it is desired to store the can or liquid container and the cup together, the cup can conveniently be positioned so as to house the can in its inner portion, thereby saving package space. The purpose of the "pressure points" is to provide some adherence of the cup to the can, so that at least a small force must be applied in order to remove the can from the cup. Providing such "pressure points" is of course within the skill of the man of the art.

The above and other characteristics and advantages of the invention will be better understood through the following illustrative and nonlimitative description of preferred embodiments, with reference to the appended drawings, wherein:

FIG. 1*a* is a perspective view of a cup according to one embodiment of the invention;

FIG. 1*b* is a top view of the cup of FIG. 1*a;*

It should be understood that the word "cup" is used broadly herein, because in some instances the device of the invention resembles a regular cup, and because it fulfills similar functions. The skilled person, however, will appreciate that drinking cups and the device of the invention are quite different, both functionally and from the constructive point of view.

Figure 1A:
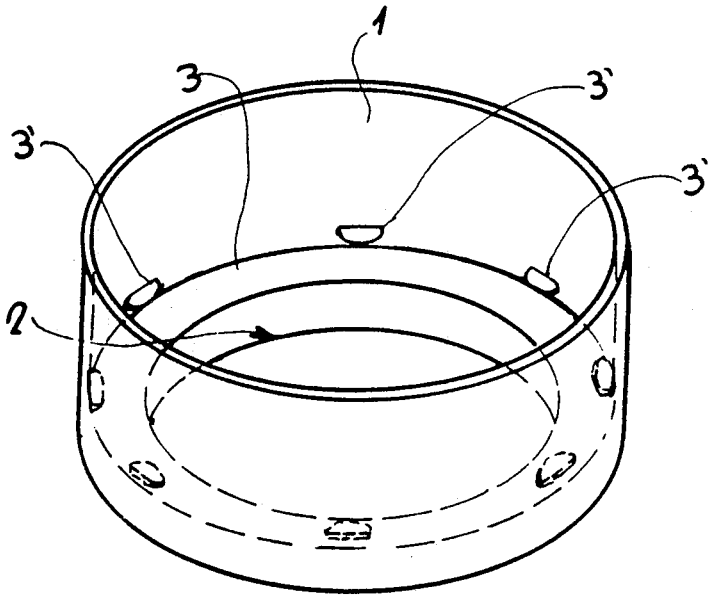
Figure 1B:
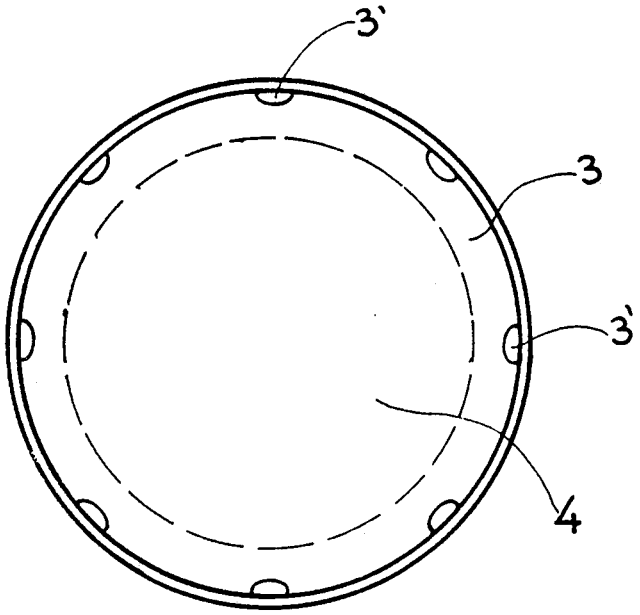

With reference now to FIG. 1*a*, the cup according to the invention comprises a drinking rim 1, outer connecting means for connecting the bottom portion of the cup to the drink can (generally indicated at 2 but not shown in detail), and positioning means which comprise a bottom rim 3 (which, in this embodiment of the invention, is the upper portion of the outer connecting and fastening means 2) and a plurality of protrusions 3' provided in the inner part of the drinking rim 1. In FIG. 1*b*, the cup of FIG. 1*a* is seen from above, a removeable bottom portion being mounted. It can be seen that the removeable bottom portion 4 is held in place by the action of the protrusions 3' and of the lower rim 3 (shown in broken lines).

Figure 2:
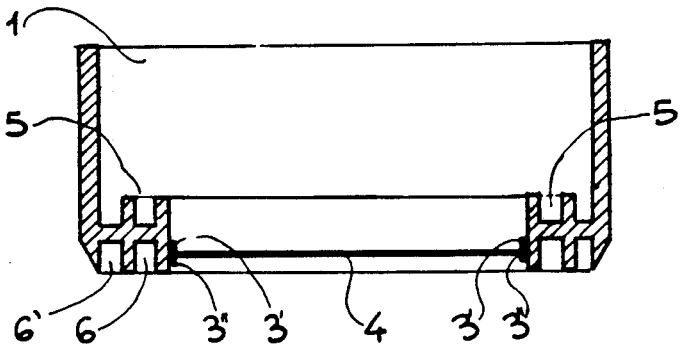
FIG. 2 is a cross-section of a device according to another embodiment of the invention.
Figure 3:
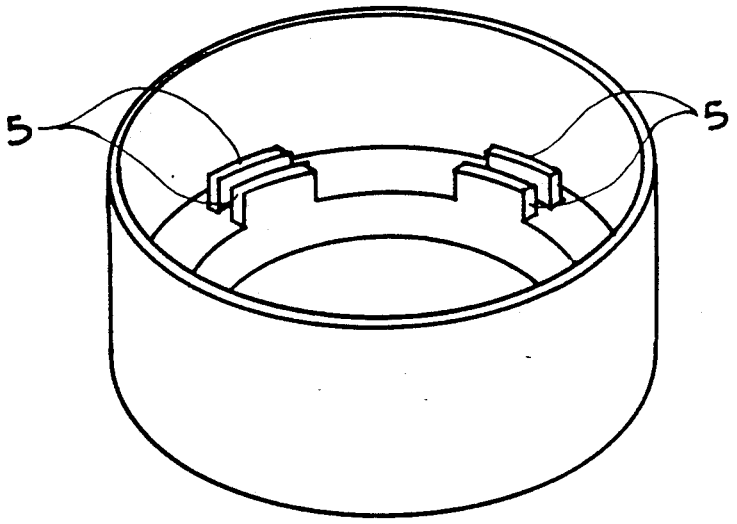
FIG. 3 is a perspective view of one variant of the device of FIG. 2.

Referring now to FIG. 2, a drinking cup according to another embodiment of the invention is shown. In this embodiment, inner connecting means 5 are provided, which comprise substantially U-shaped elements, which elements may have different shapes, different length, and may even consist of a substantially circular rim. The diameter of the cup is such that, when it is turned upside down, the U-shaped elements 5 engage the upper rim of the can when a slight pressure is applied. In this embodiment of the invention, the positioning elements comprise upper and lower protrusions, 3' and 3'' respectively, and the removeable bottom portion 4 is held in the desired position between them, as schematically shown in cross-section in the figure. As said, the inner fastening means 5 can have different shapes and can be present in different numbers. Two outer fastening and connecting means, 6 and 6', each having a substantially U-shaped cross-section are provided, for cans having different diameters of rims. FIG. 3 schematically shows a situation in which a plurality of small inner connecting means 5 are provided in the inner part of the cup.

Figure 4:
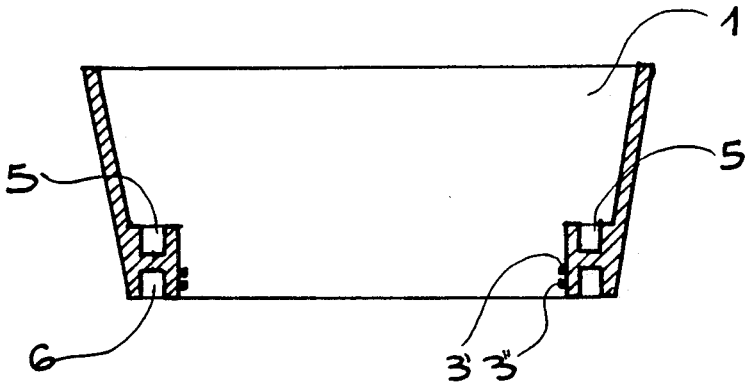
FIG. 4 is a cross-section of a cup according to another preferred embodiment of the invention.

FIG. 4 shows a different embodiment of the invention, which is similar to the embodiment of FIG. 2. In this embodiment, however, only one bottom outer fastening and connecting means are provided, which are indicated by numeral 6. Furthermore, in this embodiment of the invention the drinking rim 1 is not substantially vertical, but has a conical shape. This is desirable in order to permit simple and easy access of the upper rim of the can, to engage the inner connecting means 5. While different shapes of a cup can be provided for this purpose, this is a convenient shape which is economical from the viewpoint of material consumption.

Figure 5:
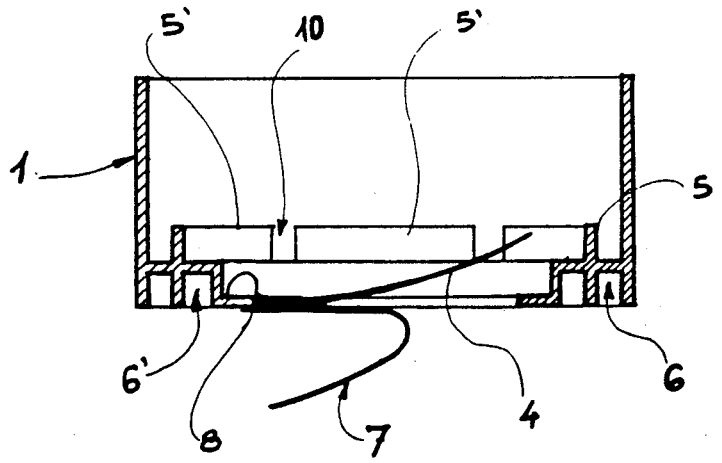
FIG. 5 is a cross-section of a device according to a preferred embodiment of the invention.

Looking now at FIG. 5, numeral 1 indicates the outer drinking rim. Numerals 6 and 6' indicate two separate bottom connecting means, which are adapted to connect the drinking attachment to upper rims of cans having different rim diameters. The inner connecting means 5 consist, in this embodiment, of a circular incompleted ring, made of sections of a ring, 5', between which openings 10 are provided, which openings have the purpose of allowing free flow of liquid which may collect in the empty space provided between the inner connecting means 5 and the drinking rim 1. An outer bottom closing portion 7 is shown in the figure, which is in semi-detached position, one edge of the bottom portion having been lifted in a peeling-off motion. An inner bottom portion 4 is also shown, which rests on the inner part of the drinking attachment, and which may be connected to the outer bottom closing portion 7 through adhesion, or which may be left free inside the drinking attachment, but which is not essential to the present invention and may be omitted entirely. This removable inner bottom portion 4 may consist, e.g., of informative material printed on one layer or multiple folded layers of plastic or paper material. When provided, this removable bottom portion may rest on a bottom circular rim 8, which can be provided around the empty circular space provided on the bottom of the drinking attachment.

Figure 6:
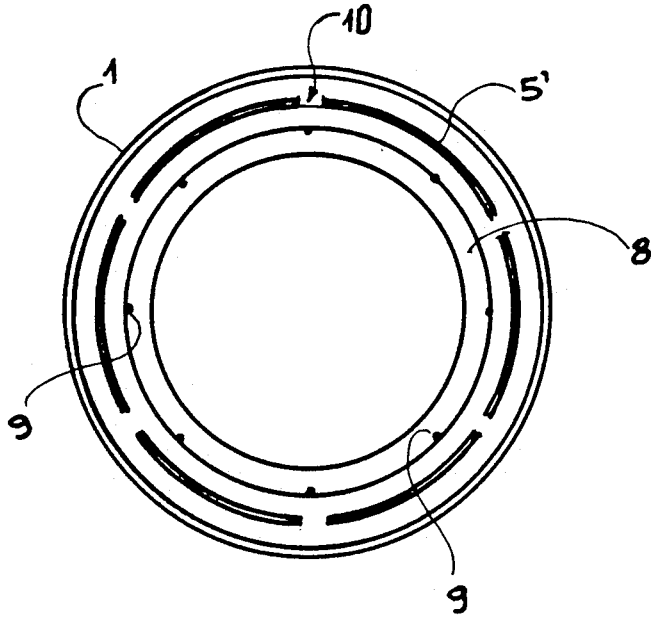
FIG. 6 is a view of the same device from above.

With reference now to FIG. 6, the same parts already described in FIG. 5 are seen, the segments of the circle 5', which constitute the inner connecting means, and the empty spaces 10 provided therein, are particularly easily seen. Also the bottom circular rim 8 can be conveniently seen, and furthermore protrusions 9 may also be provided above the said circular rim 8. These protrusions may help in keeping an inner removable bottom portion in place, for instance if this is made of cardboard, by the action of radial pressure which they apply on such a bottom portion.

Figure 7:
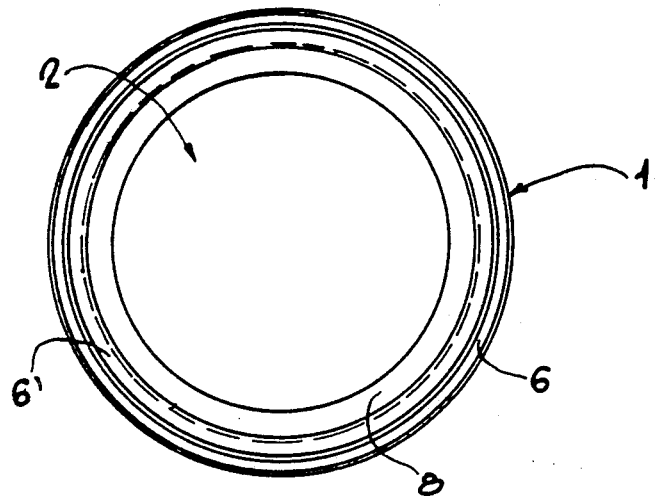
FIG. 7 is a bottom view of the same device, the removable bottom portion having been removed.

FIG. 7 is a bottom view of the device according to this embodiment of the invention. In this figure, the bottom connecting means 6 and 6' are easily seen, and also the bottom circular rim 8, which is optional but which can conveniently be provided, is easily seen. The central circular empty space 2, through which liquid freely flows, is also seen in this figure.

Figure 8:
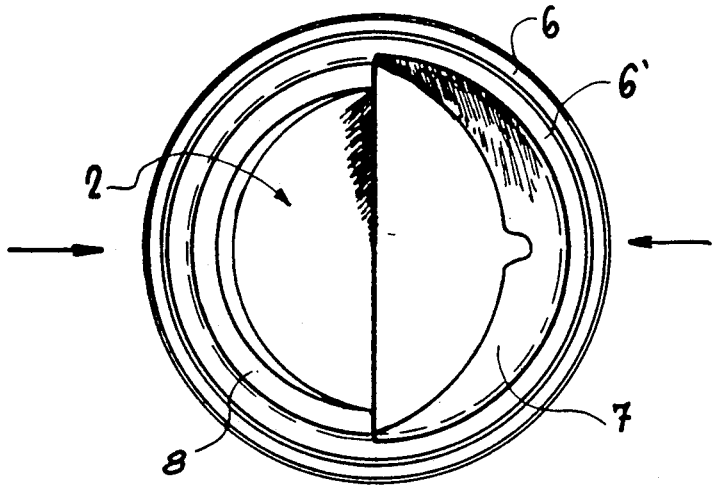
FIG. 8 is a perspective view, taken from the bottom part of the device, in which peeling of a removable outer bottom closing portion is shown.

In FIG. 8, the device is seen in slight perspective, and the empty space 2 is partially occluded by an outer removable bottom portion 7, which is seen in the same position as in FIG. 5. In this embodiment of the invention, adhesive material is provided in the inner portion of the bottom closing portion 7, which adhesive material adheres to the bottom portion of the circular bottom rim 8.

As will be readily understood by a person skilled in the art, many different types of bottom closing portions 7 can be provided, which may be attached to the bottom portion of the drinking attachment, e.g., by mechanical means, or by any other device which securely connects the said outer bottom portion to the bottom of the drinking attachment. As stated, adhesive materials are preferred because of ease of connection and because they are easily removed before use. However, any other convenient means of removably connecting the outer bottom closing portion to the bottom part of the drinking attachment is intended to be covered by this invention, and particularly devices directed to this purpose do not exceed the scope of the present invention.

Figure 9:
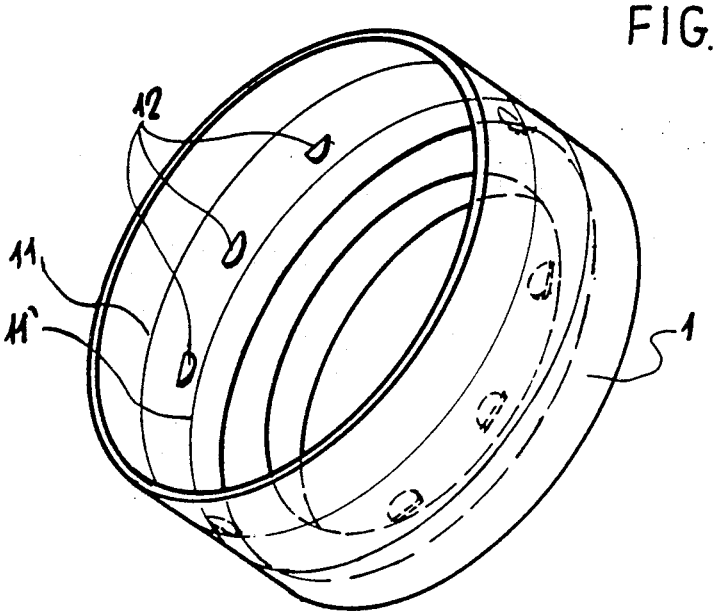
FIG. 9 shows a perspective view of a cup in which different "pressure points" are provided.

FIG. 9 shows a cup according to the invention, in which "pressure points" in the inner portion of the drinking rim can be seen. These pressure points may be provided by one or more circular rings, designated by numerals 11 and 11' in the figure, or by segments of such rings, which have a thickness slightly greater than that of the drinking rim or wall itself. Another example of such pressure points is shown at 12, and consists, e.g., of a plurality of points located in the inner portion of the drinking rim, the thickness of which is greater than the thickness of the rim itself.

As will be apparent to the skilled engineer, the improved cups described herein provide greater flexibility both in production and in use. The skilled person will of course be able to provide a very large number of different combinations of the preferred embodiments described herein and in the parent application, by varying shapes, sealing and fastening means, rim sizes, diameters and shapes, etc., all without exceeding the scope of the invention.

I claim:

1. A drinking attachment for drinking a liquid from a drink can, the drink can having an upper portion and an upper rim, said drinking attachment comprising a bottom portion adapted to be attached to the drink can in a mounted drinking position, a drinking rim portion connected to said bottom portion and adapted to receive liquid flowing out of the can, said rim portion being suitable for directly drinking therefrom, said rim portion having a diameter greater than the upper portion of the drink can and adapted to house the upper portion of the drink can, and inner connecting means connected to said bottom portion and adapted to connect said drinking attachment, when turned upside down, to the upper rim of the drink can, said inner connecting means being adapted to engage the upper rim of the drink can in a bayonet-like engagement, when pressure is applied to the bottom of the drink can.

2. A drinking attachment according to claim 1 wherein said inner connecting means comprises at least two substantially U-shaped elements.

3. A drinking attachment according to claim 1 wherein said inner connecting means comprises circular connecting means having a substantially U-shaped cross-section.

4. A drinking attachment according to claim 1 further comprising outer connecting and fastening means.

5. A drinking attachment according to claim 1 further comprising positioning means connected to said bottom portion of said drinking attachment and a removable bottom member maintained in a predetermined position by said positioning means.

6. A drinking attachment according to claim 5 wherein said removable bottom member contains a visual or written message.

7. A drinking attachment according to claim 5 wherein said removable bottom member is made of paper or paper-like material.

8. A device as in claim 1, further comprising a plurality of areas in the inner surface of said drinking rim portion, which areas have a thickness greater than the thickness of said drinking rim portion, said areas creating a pressure point.

* * * * *